US008012407B2

(12) United States Patent
Palfreman et al.

(10) Patent No.: US 8,012,407 B2
(45) Date of Patent: Sep. 6, 2011

(54) POWER CLAMPING FOR WATER BOXES

(75) Inventors: Matthew Palfreman, Charlton, MA (US); Brian Vallimont, Arlington, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 571 days.

(21) Appl. No.: 12/168,968

(22) Filed: Jul. 8, 2008

(65) Prior Publication Data

US 2010/0006188 A1 Jan. 14, 2010

(51) Int. Cl.
*C21D 1/62* (2006.01)

(52) U.S. Cl. ..... 266/113; 148/547; 148/548; 266/114; 266/46; 266/259

(58) Field of Classification Search ..... 266/114, 266/113, 46, 259; 148/547, 548, 333, 622
See application file for complete search history.

(56) References Cited

U.S. PATENT DOCUMENTS

| | | | | |
|---|---|---|---|---|
| 5,257,511 | A * | 11/1993 | Shore et al. | 62/373 |
| 7,052,647 | B2 * | 5/2006 | Fujibayashi et al. | 266/114 |
| 7,556,701 | B2 * | 7/2009 | Fujibayashi et al. | 148/333 |
| 2002/0074699 | A1 * | 6/2002 | Hellenbrandt et al. | 266/134 |

FOREIGN PATENT DOCUMENTS

| | | | |
|---|---|---|---|
| EP | 0561536 | A1 | 9/1993 |
| EP | 1797971 | A1 | 6/2007 |

* cited by examiner

*Primary Examiner* — Scott Kastler
*Assistant Examiner* — Michael Aboagye
(74) *Attorney, Agent, or Firm* — Seyed Kaveh E. Rashidi-Yazd

(57) ABSTRACT

A water box for use in cooling a hot rolled product in a rolling mill comprises a plurality of nozzles arranged sequentially along a first axis. The nozzles are subdivided into base and top sections, with the top sections being adjustable between closed positions coacting with the base sections to define tubular enclosures through which the product is directed, and open positions. A clamp support extends in parallel relationship to the first axis, and carries clamp members. An operating mechanism adjusts the clamp support between an open setting at which the clamp members are separated from the nozzle top sections and the nozzle top sections are adjustable to their open positions, and a closed setting at which the top sections are in their closed positions and the clamp members are in contact with and urge the top sections into their closed positions.

13 Claims, 7 Drawing Sheets

POWER CLAMPING FOR WATER BOXES

BACKGROUND DISCUSSION

1. Field of the Invention

This invention relates generally to rolling mills producing hot rolled long products such as bars, rods and the like, and is concerned in particular with an improvement to the water boxes employed to cool such products.

2. Description of the Prior Art

Conventional water boxes typically comprise a housing containing a plurality of nozzles arranged sequentially along the path of the hot rolled product. The nozzles are subdivided into base and top sections which coact to define tubular enclosures containing replaceable sleeves. The base sections are fixed in place on a common underlying manifold, and the top sections are adjustable between closed positions and open positions allowing access to the sleeves. The nozzles are supplied via the manifold with pressurized water which serves to cool the hot rolled product.

Conventionally, the nozzle top sections are closed by so called "C clamps" that are manually set by mill personnel. This is a time consuming task requiring attention to detail to insure that the necessary high level of torque is applied to each clamp. Failure to do so can result in nozzle leakage and a loss of cooling efficiency.

The present invention addresses these problems by providing a mechanism for automatically applying a correct clamping force to the closed top sections, and in a preferred embodiment, for also simultaneously opening and closing the nozzle top sections.

SUMMARY OF THE INVENTION

In accordance with one aspect of the present invention, a water box comprises a plurality of nozzles arranged sequentially along a first axis. The nozzles are subdivided into base and top sections, with the top sections being pivotally adjustable about a second axis parallel to the first axis between closed positions coacting with the base sections to define tubular enclosures containing replaceable sleeves through which a hot rolled product is directed, and open positions allowing access to the sleeves. A torque shaft is rotatable about a third axis parallel to the first and second axes. A linkage connects the nozzle top sections to the torque shaft. Clamp members are carried by the torque shaft. The torque shaft is rotatably adjustable between an open setting at which the clamp members are separated from the nozzle top sections and the top sections are in the open positions, and a closed setting at which the top sections are closed and the clamp members are in contact with and urging the top sections into the closed positions.

In accordance with another aspect of the present invention, the clamp members include springs for resiliently urging the top sections into their closed positions.

In accordance with still another aspect of the present invention, the nozzles are enclosed within a housing having a door pivotally adjustable about a fourth axis parallel to the first, second, and third axes. Arm members project radially from the torque shaft. The arm members are engageable with the door during rotation of the torque shaft between its open and closed settings to pivotally adjust the door about the fourth axis between open and closed positions.

In accordance with still another aspect of the present invention, the clamp members are carried by a vertically adjustable support in the form of a beam extending in parallel relationship with the first axis. In this embodiment, the nozzle top sections are manually adjusted between their open and closed positions, with the vertically adjustable beam support serving only to automatically apply a closure force acting through the clamp members to urge the nozzle top sections into their closed positions.

These and other features and attendant advantages will now be described in greater detail with reference to the accompanying drawings, wherein:

DETAILED DESCRIPTION

With reference initially to FIGS. 1-4, an apparatus in accordance with one embodiment of the present invention comprises a dual sided water box 10 for cooling hot rolled products moving longitudinally along parallel pass lines (hereinafter "first axes") $A_1$, $A_1$. The dual sides of the water box are mirror images of each other, and thus a detailed description of the components on one side is equally applicable to the components of the other side.

Figure 4:
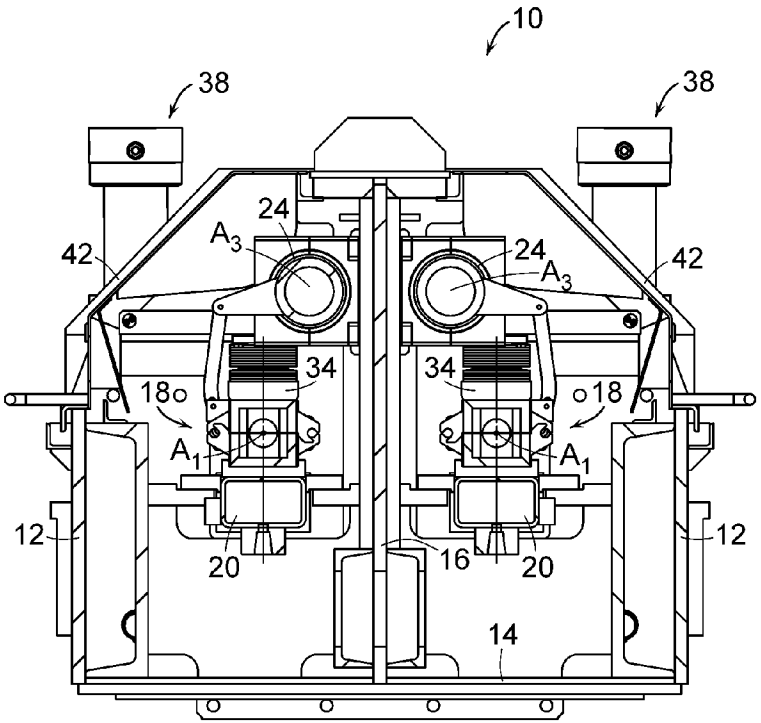
FIG. 4 is a sectional view on an enlarged scale taken along line 4-4 of FIG. 2.

As can best be seen in FIG. 4, the water box includes reinforced side walls 12 projecting upwardly from a bottom wall 14 to define an enclosure interiorly subdivided into two halves by a central wall 16.

Figure 6:
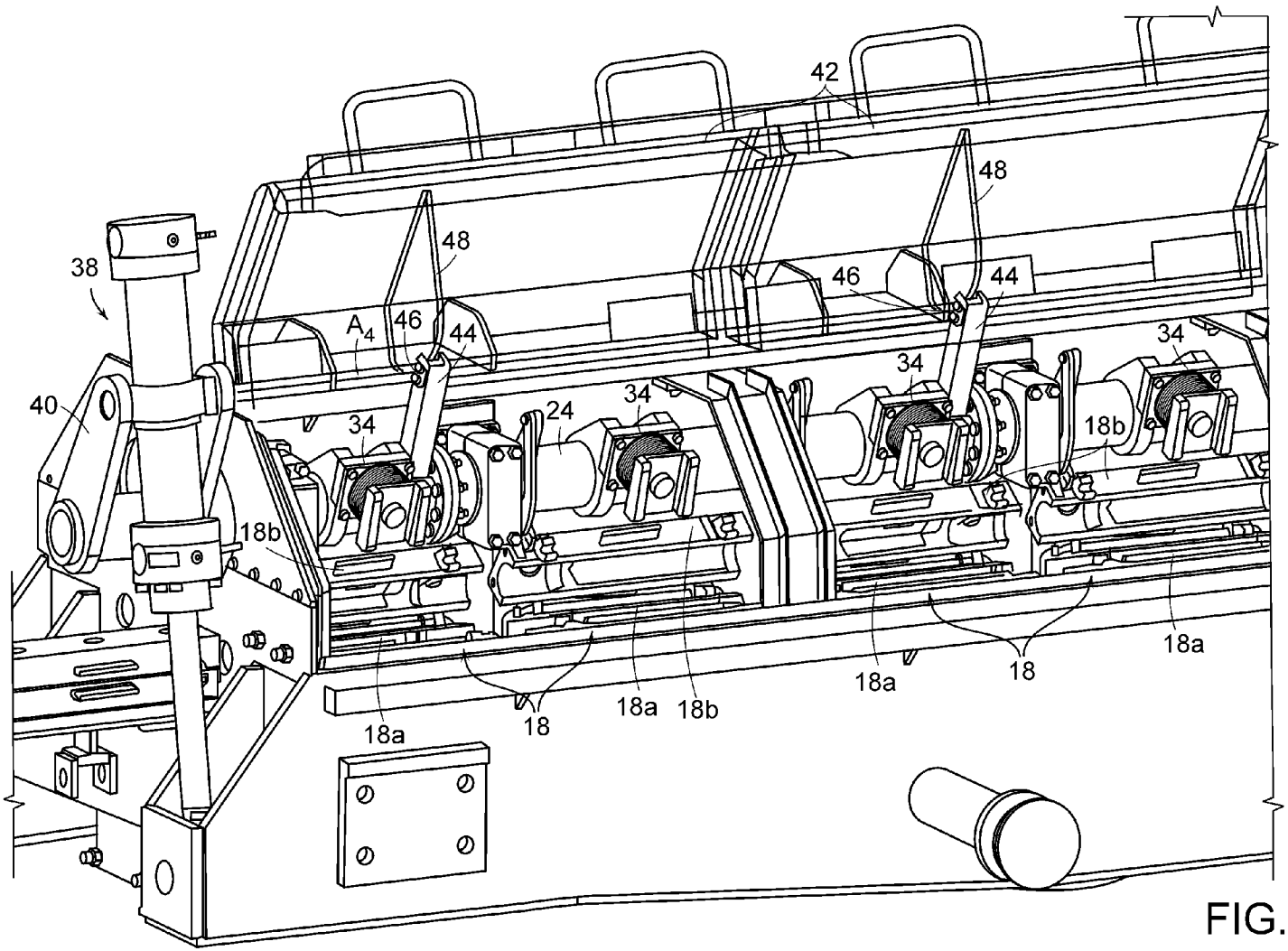
FIG. 6 is a perspective view of one end of the water box, showing the cover and nozzles open.
Figure 7:
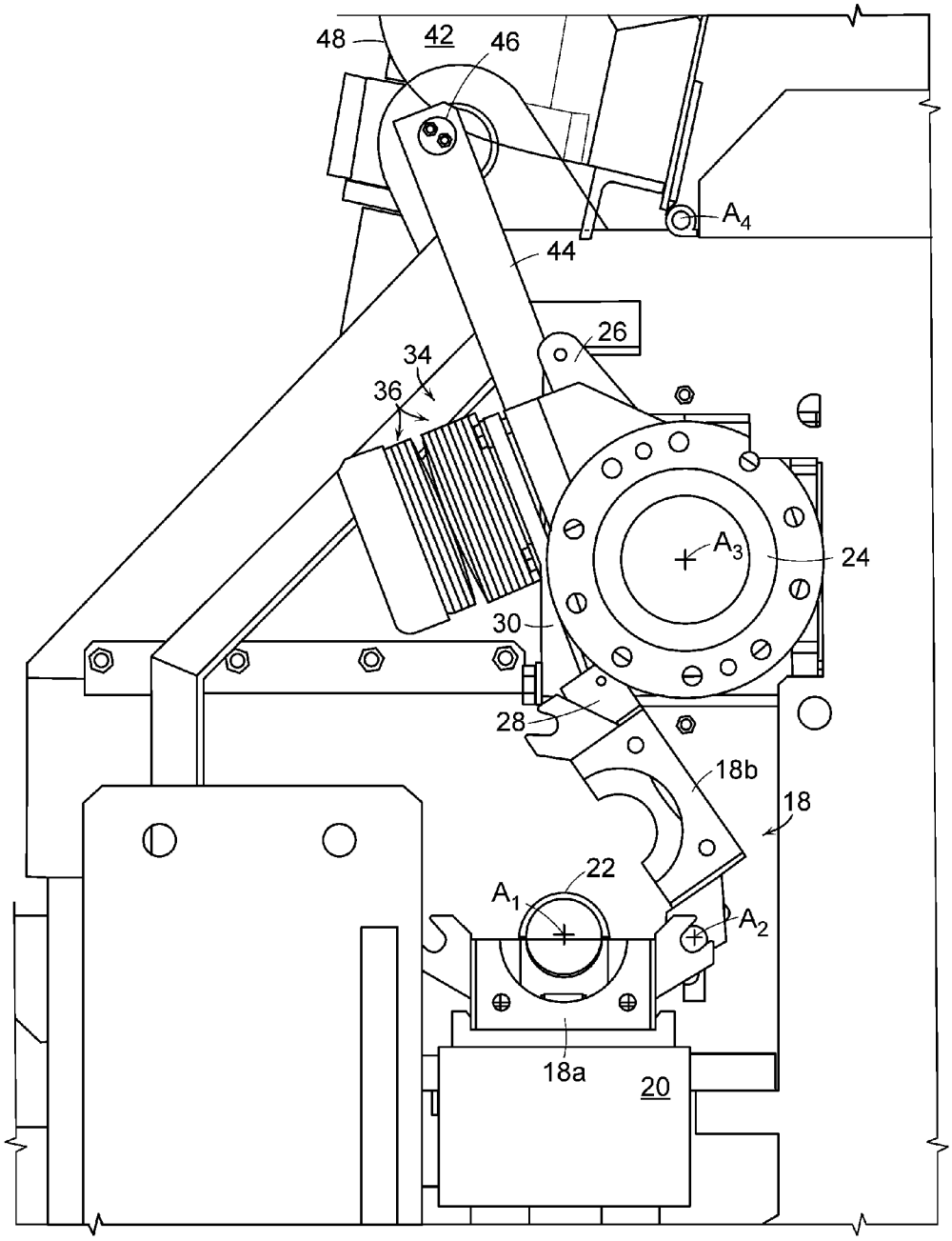
FIG. 7 is an enlarged view of a nozzle and clamping mechanism in the open condition.
Figure 8:
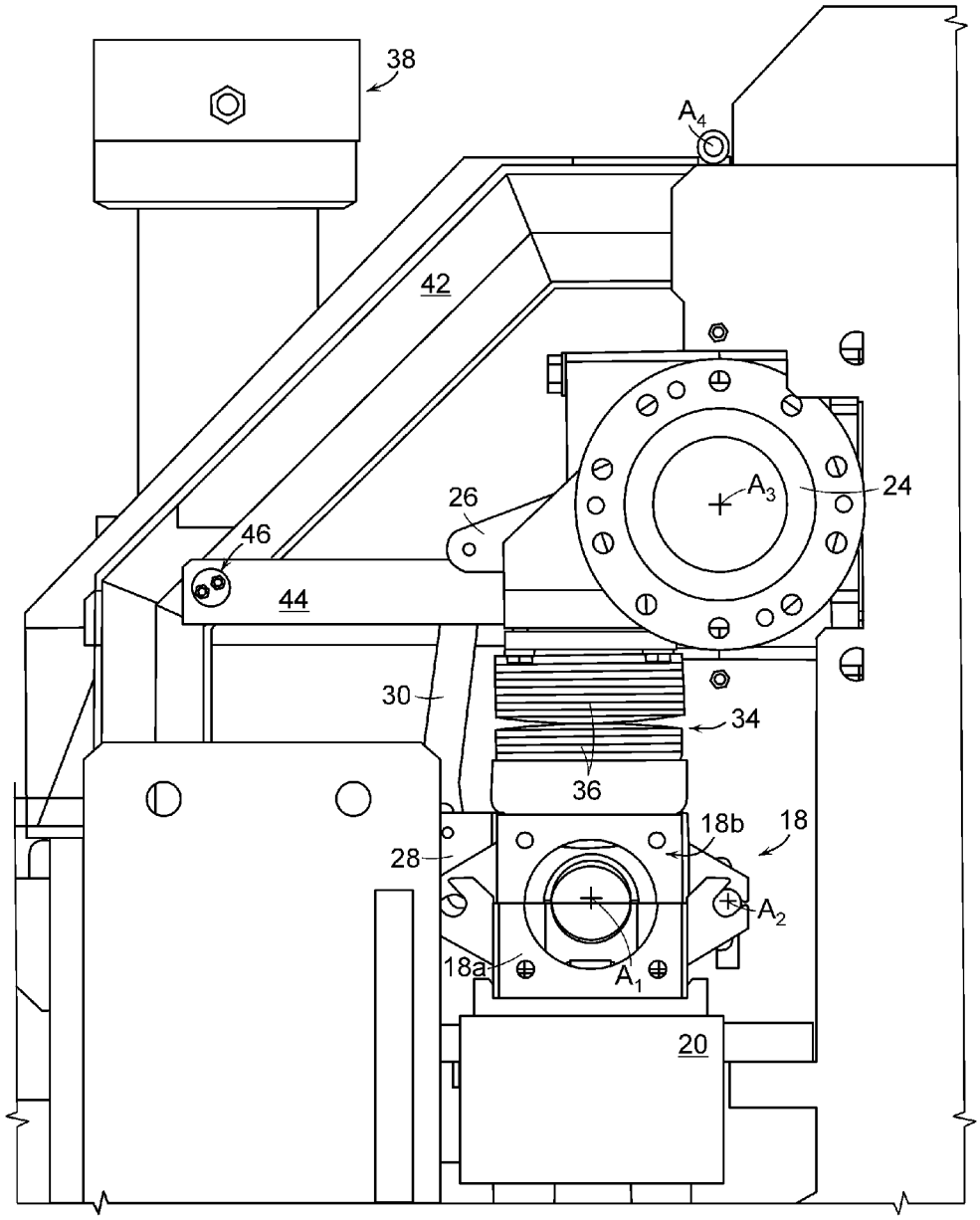
FIG. 8 is a view similar to FIG. 7 showing a nozzle and clamping mechanism in the closed condition.

With reference additionally to FIGS. 6-8, a plurality of water nozzles 18 are arranged sequentially along each of the first axes $A_1$. The nozzles are subdivided into base and top sections 18*a*, 18*b*, with the top sections being pivotally adjustable about second axes $A_2$ parallel to the first axes $A_1$. The base sections 18*a* are fixed to and in communication with an underlying water manifold 20. The top sections 18*b* are adjustable between closed positions (as shown in FIGS. 4 and 8) coacting with the base sections to define tubular enclosures containing replaceable sleeves 22, and open positions (as shown in FIGS. 6 and 7) allowing access to the sleeves 22.

A torque shaft 24 is rotatable about a third axis $A_3$ parallel to the first and second axes $A_1$, $A_2$. The torque shaft 24 is connected to each of the nozzle top sections 18*b* by a linkage assembly comprising a crank arm 26 projecting radially from the torque shaft, a flange 28 projecting laterally from the nozzle top section 18*b*, and an intermediate connecting link 30. Clamp members 34 are carried by and are rotatable with the torque shaft 24. The clamp members preferably include one or more packages of disc springs 36.

Operating means in the form of linear actuators 38 are provided externally at opposite ends of the water box. Each linear actuator is mechanically coupled to the torque shaft 24 by a linkage 40. The linear actuators serve to rotatably adjust the torque shaft 24 between an open setting (as shown in FIGS. 6 and 7) and a closed setting (as shown in FIGS. 4 and 8). When in its open setting, the torque shaft serves to pivotally and simultaneously open the nozzle top sections 18*b*, with the clamp members 34 being separated from the top sections. In its closed setting, the torque shaft operates to pivotally and simultaneously close the nozzle top sections 18*b* and to apply the clamp members 34 to the top sections, with the disc springs 36 serving to exert a resilient closure force.

Figure 1:
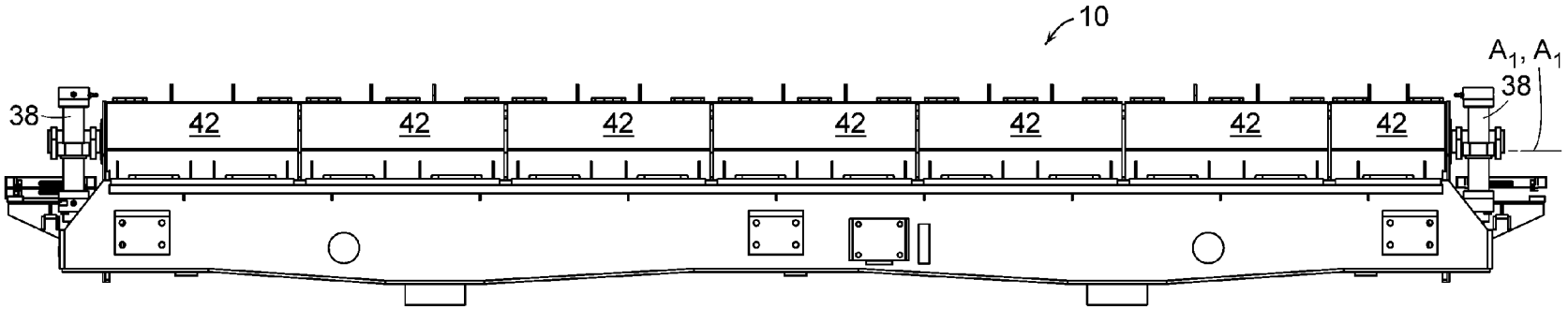
FIG. 1 is a side view of a water box in accordance with the one embodiment of the present invention.
Figure 2:
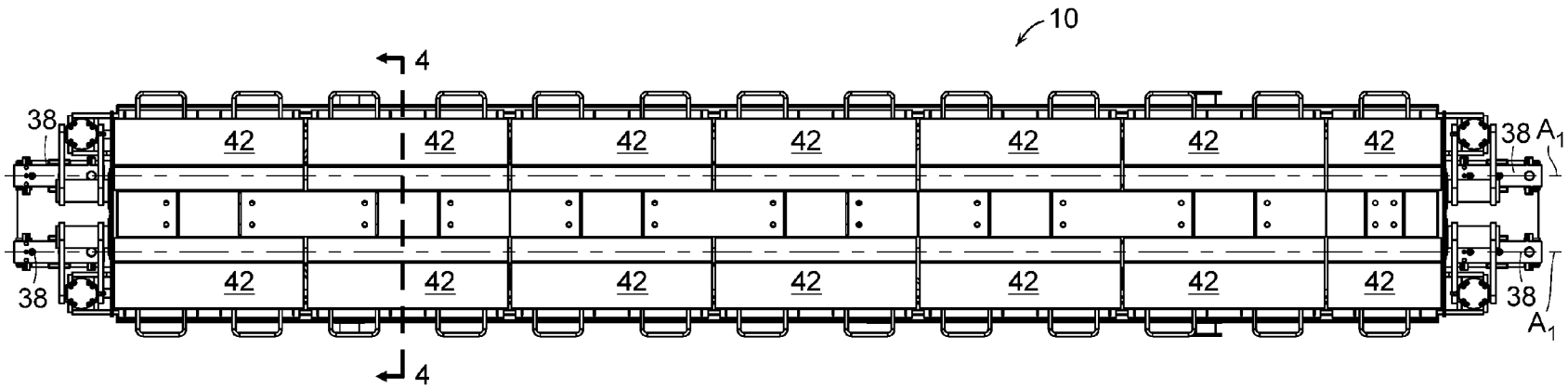
FIG. 2 is a top plan view of the water box.
Figure 3:
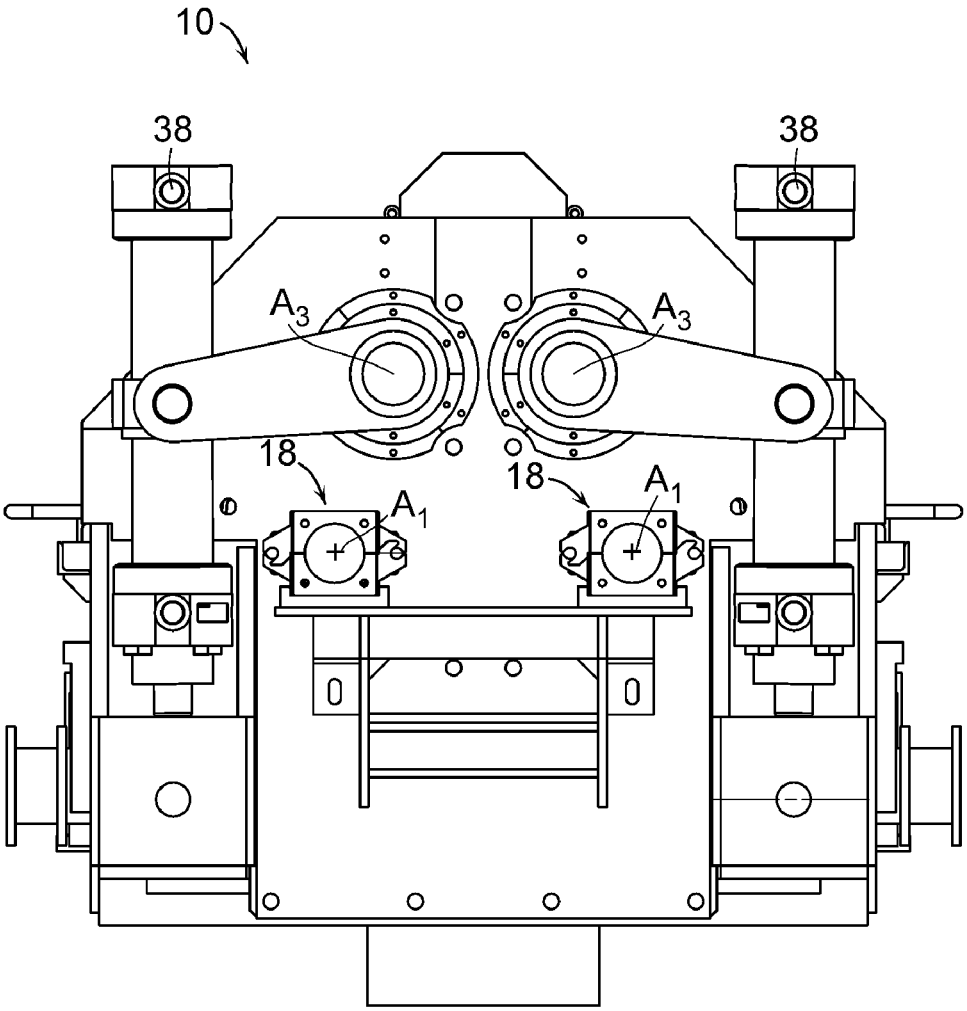
FIG. 3 is an enlarged end view of the water box.
Figure 5:
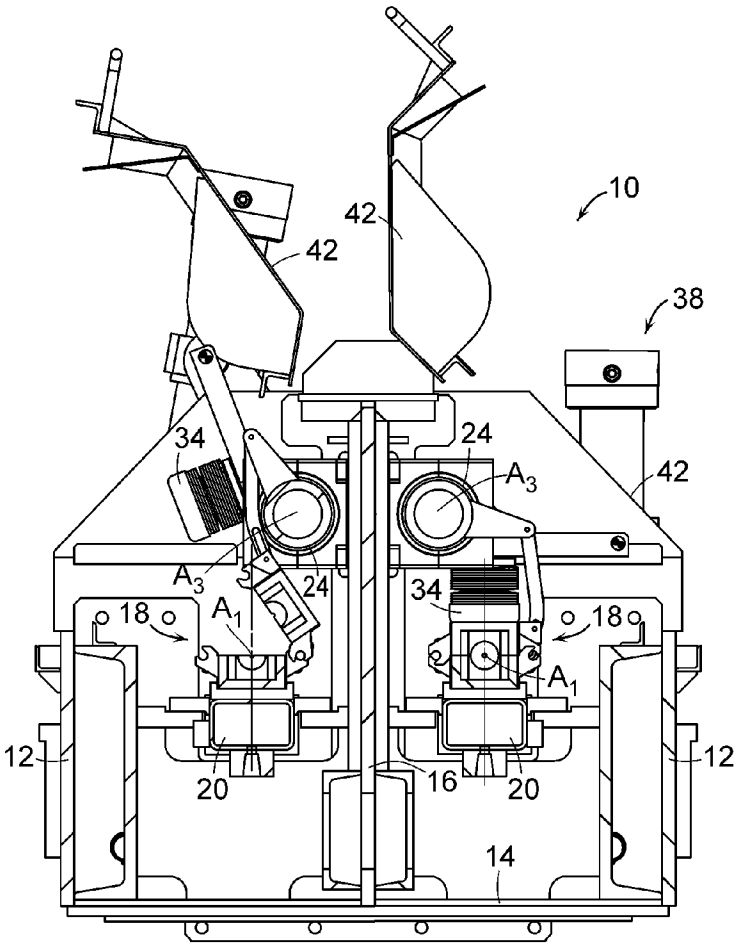
FIG. 5 is a view similar to FIG. 4, showing the nozzles and housing cover open on the left hand side, and showing the cover open with the nozzles closed on the right hand side.

The water box interior is closed by covers 42 mounted for pivotal movement about a fourth axis $A_4$ between closed positions as shown in FIGS. 1-4, and open positions as shown in FIGS. 5 and 6. As can best be seen in FIGS. 6-8, the torque shaft 24 is additionally provided with radially projecting cover lifting arms 44 having rollers 46 engageable with the curved edges of interior ribs 48 spaced along the undersides of the covers 42. When the torque shaft is rotated from its closed to its open setting, the lifting arms 44 serve to open the covers. This condition is illustrated on the left hand side of FIG. 5. Optionally, as shown on the right hand side of FIG. 5, the covers may be opened manually, leaving the torque shaft in its closed setting, with the nozzle top sections 18*b* resiliently urged into their closed positions.

Figure 9:
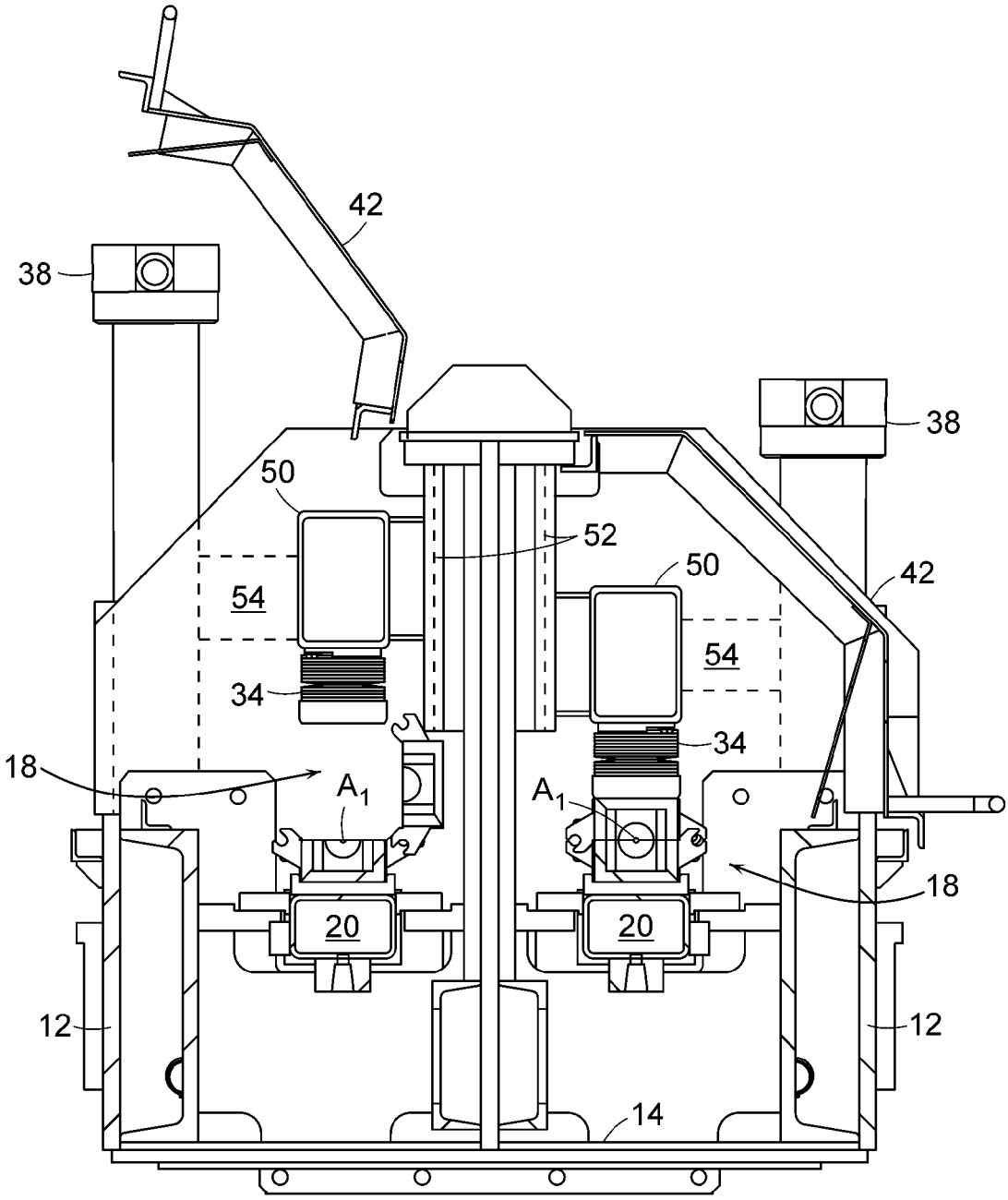
FIG. 9 is a sectional view similar to FIG. 4 depicting an alternative embodiment of the invention.

Referring now to FIG. 9, an alternative embodiment of the invention is shown in which the clamp members 34 are carried on beam supports 50 extending over the length of the water box in parallel relationship with the first axes $A_1$. The clamp members 34 are carried on the beam support 50, the latter being mounted for vertical adjustment on tracks 52. The beam supports 50 are connected by laterally extending brackets 54 to the linear actuators 38.

With this embodiment, the nozzle top sections are individually and manually adjusted between their open and closed positions, and the covers 42 are also manually opened and closed. The linear actuators 38 serve to adjust the beam supports 50 between raised positions (left hand side of FIG. 9) at which the clamp members 34 are raised to accommodate opening of the nozzle top sections and lowered positions (right hand side of FIG. 9) at which the clamp members serve to resiliently urge the nozzle top sections into their closed positions.

In light of the foregoing, it will now be appreciated by those skilled in the art that the present invention offers significant advantages to mill operating personnel. For example, the nozzles serving a pass line can be opened and closed in unison without having to manually loosen and tighten individual clamps. The nozzle top sections are held in their closed positions by resilient forces that insure water tight integrity, again without the need for individual attention by operating personnel.

We claim:

1. An apparatus for use in cooling a hot rolled product in a rolling mill said apparatus comprising:

a plurality of nozzles arranged sequentially along a first axis, said nozzles being subdivided into base and top sections, with said top sections being adjustable between closed positions and open positions, said top sections when in said closed positions coacting with said base sections to define tubular enclosures through which said product is directed;

a clamp support common to the plurality of nozzles and extending in parallel relationship to said first axis;

clamp members carried by said clamp support;

an operating assembly adapted to adjust said clamp support between an open setting at which said clamp members are separated simultaneously from said top sections to accommodate adjustment of said top sections to said open positions, and a closed setting at which said top sections are in said closed positions and said clamp members are applied simultaneously to contact and urge said top sections into said closed positions; and a supply assembly for providing a liquid coolant to said nozzles.

2. The apparatus of claim 1, wherein said clamp members include means for resiliently urging said top sections into said closed positions.

3. The apparatus of claim 1, wherein said top sections are pivotally adjustable between said closed and open positions about a second axis parallel to said first axes.

4. The apparatus of claim 3, wherein said clamp support comprises a torque shaft rotatable about a third axis parallel to said first and second axes.

5. The apparatus of claim 4, further comprising a linkage assembly for connecting said top sections to said torque shaft, said operating means serving to rotatably adjust said torque shaft between said open and closed settings, with said linkage means serving to open and close said top sections in response to rotation of said torque shaft between said open and closed settings.

6. The apparatus of claim 5, wherein said nozzles are enclosed within a housing having a cover pivotally adjustable about a fourth axis parallel to said first, second, and third axes, and arm members projecting radially from said torque shaft, said arm members being engageable with said cover during rotation of said torque shaft between said open and closed settings to pivotally adjust said cover about said fourth axis between open and closed positions.

7. The apparatus of claim 4, wherein said operating assembly comprises a linear actuator mechanically coupled to said torque shaft.

8. The apparatus of claim 1, wherein said clamp support is vertically adjustable between said open and closed settings.

9. The apparatus of claim 2, wherein the top sections are pivotally adjustable between the closed and open positions about a second axis parallel to the first axis.

10. The apparatus of claim 2, wherein the clamp support is vertically adjustable between the open and closed settings.

11. An apparatus for use in cooling a hot rolled product in a rolling mill, the apparatus comprising:

a plurality of nozzles arranged sequentially along a first axis, the nozzles being subdivided into base and top sections, with the top sections being pivotally adjustable about a second axis parallel to the first axis between closed positions and open positions, said top sections when in said closed positions coacting with the base sections to define tubular enclosures through which the product is directed;

a torque shaft rotatable about a third axis parallel to the first and second axes;

clamp members carried by a clamp support;

linkage means for connecting the top sections to the torque shaft;

operating means for rotatably adjusting the torque shaft between an open setting at which the clamp members are separated from the top sections and the top sections are adjustable to the open positions, and a closed setting at which the top sections are in the closed positions and the clamp members are applied simultaneously to in contact with and urge the top sections into the closed positions;

a housing enclosing the nozzles and having a cover pivotally adjustable about a fourth axis parallel to the first, second, and third axes, arm members projecting radially from the torque shaft, the arm members being engageable with the cover during rotation of the torque shaft between the open and closed settings to pivotally adjust the cover about the fourth axis between open and closed positions; and means for supplying a liquid coolant to the nozzles.

12. A device for use in cooling a hot product, the device comprising:

a plurality of nozzles arranged sequentially along a first axis, each of the plurality of nozzles being subdivided into base and top sections, the top section being adjustable between a closed position and open position, said top section when in said closed position coacting with the base section to define a tubular enclosure through which the product is directed; and an adjusting system adapted to secure the top section to the base section in the closed position and further adapted to apply a correct clamping force to the top section to securedly maintain the closed position further comprising: a clamp support common to the plurality of nozzles and extending in a parallel relationship to the first axis; and clamp members carried by the clamp support.

13. The device of claim 12, further comprising a supply assembly for providing a liquid coolant to the plurality of nozzles.

* * * * *